United States Patent [19]

Huffman et al.

[11] Patent Number: 4,821,844

[45] Date of Patent: Apr. 18, 1989

[54] OUTRIGGER FOR SCAFFOLDING

[76] Inventors: Cary A. Huffman, 5005 Montgomery St.; Emory L. Thompson, 4813 Montgomery St., both of Annandale, Va. 22003

[21] Appl. No.: 179,776

[22] Filed: Apr. 11, 1988

[51] Int. Cl.[4] ..... E04G 1/15

[52] U.S. Cl. ..... 182/179; 182/130; 248/235

[58] Field of Search ..... 182/178, 179, 82, 130, 182/132; 248/235

[56] References Cited

U.S. PATENT DOCUMENTS

| | | | |
|---|---|---|---|
| 2,125,830 | 8/1938 | Uecker | 248/235 |
| 2,833,503 | 5/1958 | Harshbarger | 248/235 |
| 2,897,013 | 7/1959 | Delp | 182/132 |
| 2,943,747 | 7/1960 | Shaw | 248/235 |
| 3,270,997 | 9/1966 | Gethmann | 248/235 |
| 3,493,208 | 2/1970 | Masataro | 248/235 |
| 3,533,592 | 10/1970 | Jennings | 182/179 |
| 3,684,058 | 8/1972 | Brown | 182/132 |
| 3,717,220 | 2/1973 | Donker | 248/235 |
| 4,372,425 | 2/1983 | Murphy | 182/179 |

*Primary Examiner*—Reinaldo P. Machado
*Attorney, Agent, or Firm*—Diller, Ramik & Wight

[57] ABSTRACT

An outrigger is designed to be used at the corner of a scaffold in generally cantilever-like fashion to underlyingly support what would normally be free projecting ends of horizontal planks projecting outboard or endwise of the scaffolding and thereby permit a worker to safely stand outboard endwise of the scaffolding, the outrigger including a pair of generally spaced parallel first and second arms each having inboard and outboard ends with a hook-like element at each inboard end to secure the outrigger by either arm to a corner of the scaffold, and the first and second arms being supported in cantilivered and extensible fashion from each other to accommodate the outrigger for varying distances between an associated scaffold buck and the work surface which is located endwise therefrom.

44 Claims, 2 Drawing Sheets

FIG.1
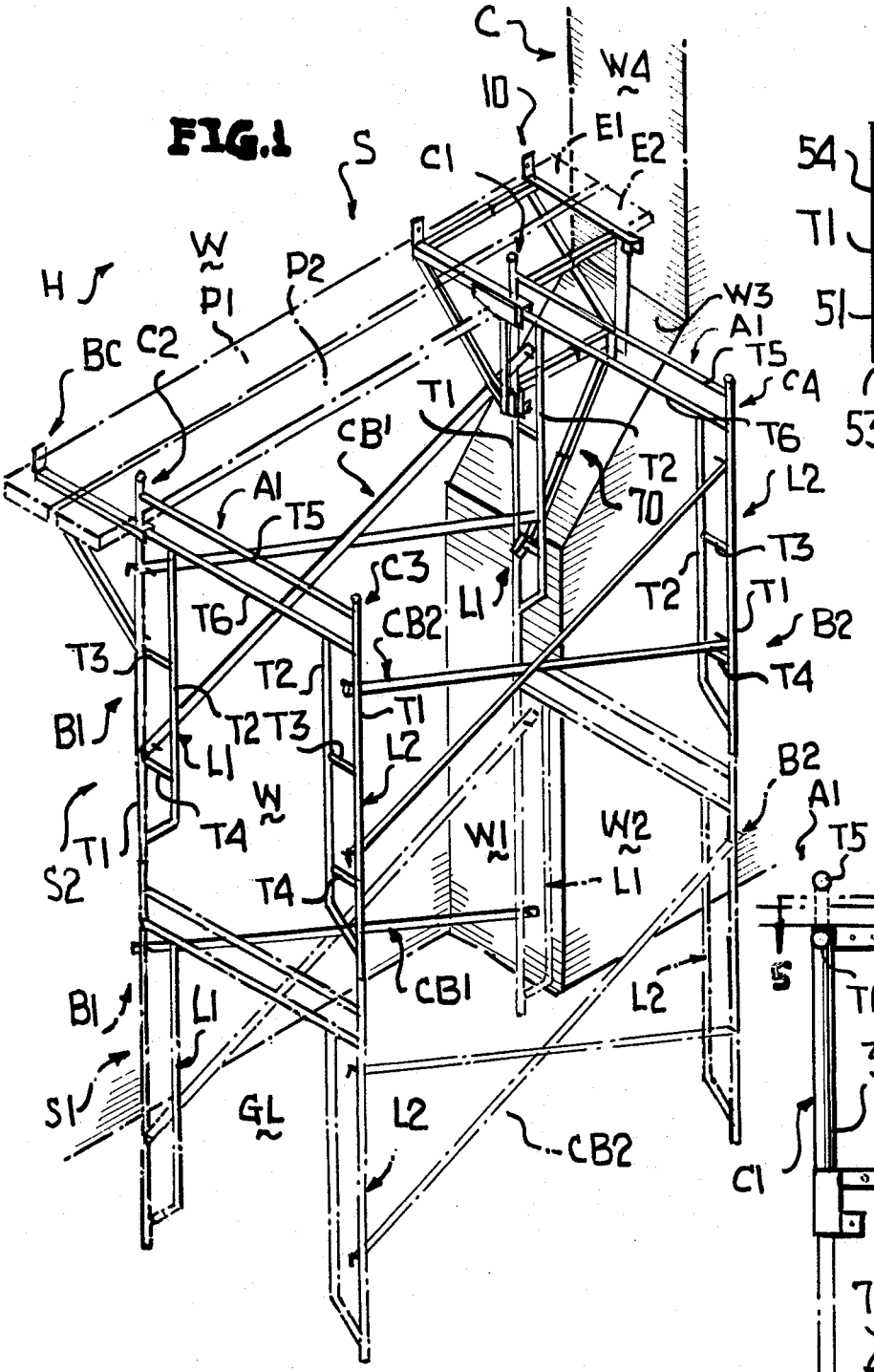
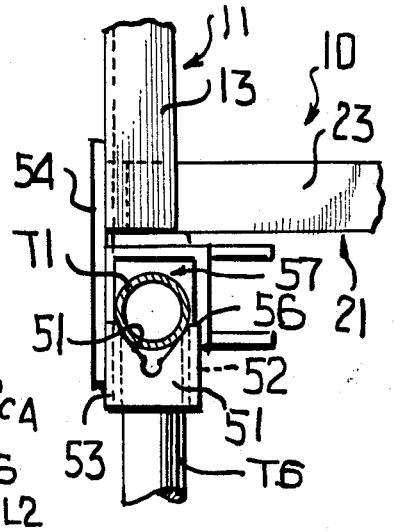
FIG.5
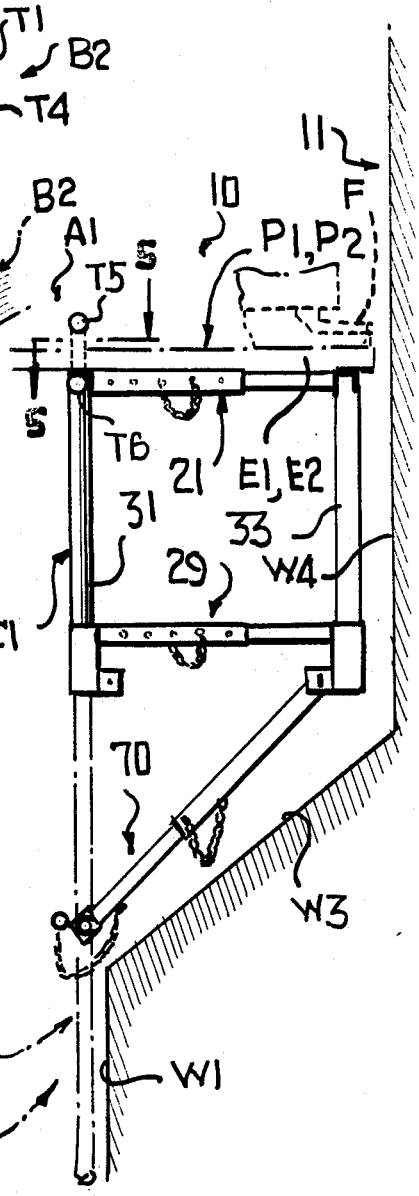
FIG.2

B2
C1
14
23
27
22
10
11
55
54
13
50
T5
A1
24
16
51
57
23
27
53
12
30
T6
25
21
24
52
56
17
26
57
51
54
T1
31
32
T2
63
62
52
53
23'
29
18
50
33
61
60
34
6
64
66
65
26'
27'
25
24'
62
63
T3
86
64
61
85
S2
74
71
73
75
72
70
T4
81
82
83
24'
65
66
33
64
61
71
70
85
86
66
62
60
22
W
W4
P1
11
20
12
E1
W3
P2
21
E2
CB1
C1
10
50
A1
70
W2

OUTRIGGER FOR SCAFFOLDING

BACKGROUND OF THE INVENTION

The field of art to which the invention pertains involves scaffolding or scaffolds in general and, more specifically outriggers or scaffold extension units for such scaffolding.

Scaffolding, particular knock-down tubular scaffolding has been utilized for years in association with building construction, and a typical example thereof is disclosed in U.S. Pat. No. 2,923,374 issued in the name of Alfred w. Harwell on Feb. 2, 1960. The scaffolding includes a plurality of end sections or "bucks" which are stacked one atop the other in opposite end sections or bucks are interconnected by removable brace members or cross-braces. Board members or planks span upper horizontal members and/or outriggers or braces which project away from the scaffolding generally sideways therefrom, namely a plane through these braces or outriggers is generally parallel to a plane through the scaffold bucks or scaffold staging.

Another such example of scaffolding in which the braces, outriggers or brackets are readily assembled upon or removed from the scaffolding is disclosed in U.S. Pat. No. 3,270,997 in the name of Kenneth W. Gethmann issued on Sept. 6, 1966.

Still another example of such scaffolding and a removable bracket for the same will be found in U.S. Pat. No. 3,493,208 Masataro Sato issued on Feb. 3, 1970.

Still another patent dealing with a removable scaffold bracket is U.S. Pat. No. 2,125,830 in the name of Reinhold A. Uecker et al issued Aug. 2, 1938.

Other patents, somewhat duplicative or redundant but dealing with the subject matter disclosed herein, are disclosed in the following patents:

| | |
|---|---|
| Stratinsky | U.S. Pat. No. 1,189,884 |
| McCormick | U.S. Pat. No. 1,710,026 |
| Uecker et al | U.S. Pat. No. 2,261,907 |
| Pignon | U.S. Pat. No. 3,223,370 |
| Whitsett | U.S. Pat. No. 3,385,400 |
| Isbell | U.S. Pat. No. 3,410,365 |
| Donker et al | U.S. Pat. No. 3,717,220 |
| Marnoch | U.S. Pat. No. 3,791,486 |
| Bruno | U.S. Pat. No. 4,002,222 |
| Murphy | U.S. Pat. No. 4,372,425 |
| Sickler | U.S. Pat. No. 4,452,336 |

SUMMARY OF THE INVENTION

The invention is an improvement over conventional outriggers which project from scaffolding in that the outrigger or scaffold extension unit is so constructed as to permit the same to be essentially hung in a cantilever fashion to project endwise from a scaffolding buck and, thus, permit planks or boards to similarly project endwise beyond the scaffold bucks in a manner heretofore unprovided for in the prior art whereby workers can stand on the ends of the planking supported by the cantilevered outrigger in complete safety. Heretofore, it was common for bricklayers, for example, to place planks across scaffolding with the ends of the planks projecting endwise beyond the scaffolding bucks. Bricks, mortar, cinder blocks or the like would be placed on the ends of the planking opposite the projecting ends and the bricklayer would then step upon the projecting ends and work as need be and required. This might be done, for example, to lay bricks along the rake or above the rake of a house chimney. However, it is not uncommon for the cantilevered planking to tip, particularly as the mortar/bricks are depleted, and the obvious result is injury to the workman or bricklayer. However, in accordance with this invention, the outrigger is securely held to the scaffold buck, projects in a cantilevered fashion endwise therefrom over the chimney rake toward the work area, and the end portion of the planks resting upon the outrigger are incapable of tilting or canting. Thus, the bricklayer or similar workman can stand in an area endwise well beyond the scaffold bucks and yet do so in a safe and secure manner.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 1 is a perspective view, and illustrates scaffolds including associated bucks and cross-braces and an outrigger of this invention suspended in a cantilever fashion from one of the scaffold bucks and projecting endwise therefrom in underlying supporting relationship to planks.

FIG. 2 is an elevational view of the outrigger looking from right-to-left in FIG. 1, and illustrates extensible arms thereof and an reinforcing brace.

FIG. 5, which appears on the sheet of drawing containing FIGS. 1 and 2, is an enlarged fragmentary cross-sectional view taken generally along line 5—5 of FIG. 2, and illustrates details of a clamp for securing the outrigger to the scaffold buck.

DESCRIPTION OF THE PREFERRED EMBODIMENTS

Figures 3, 4, 6:
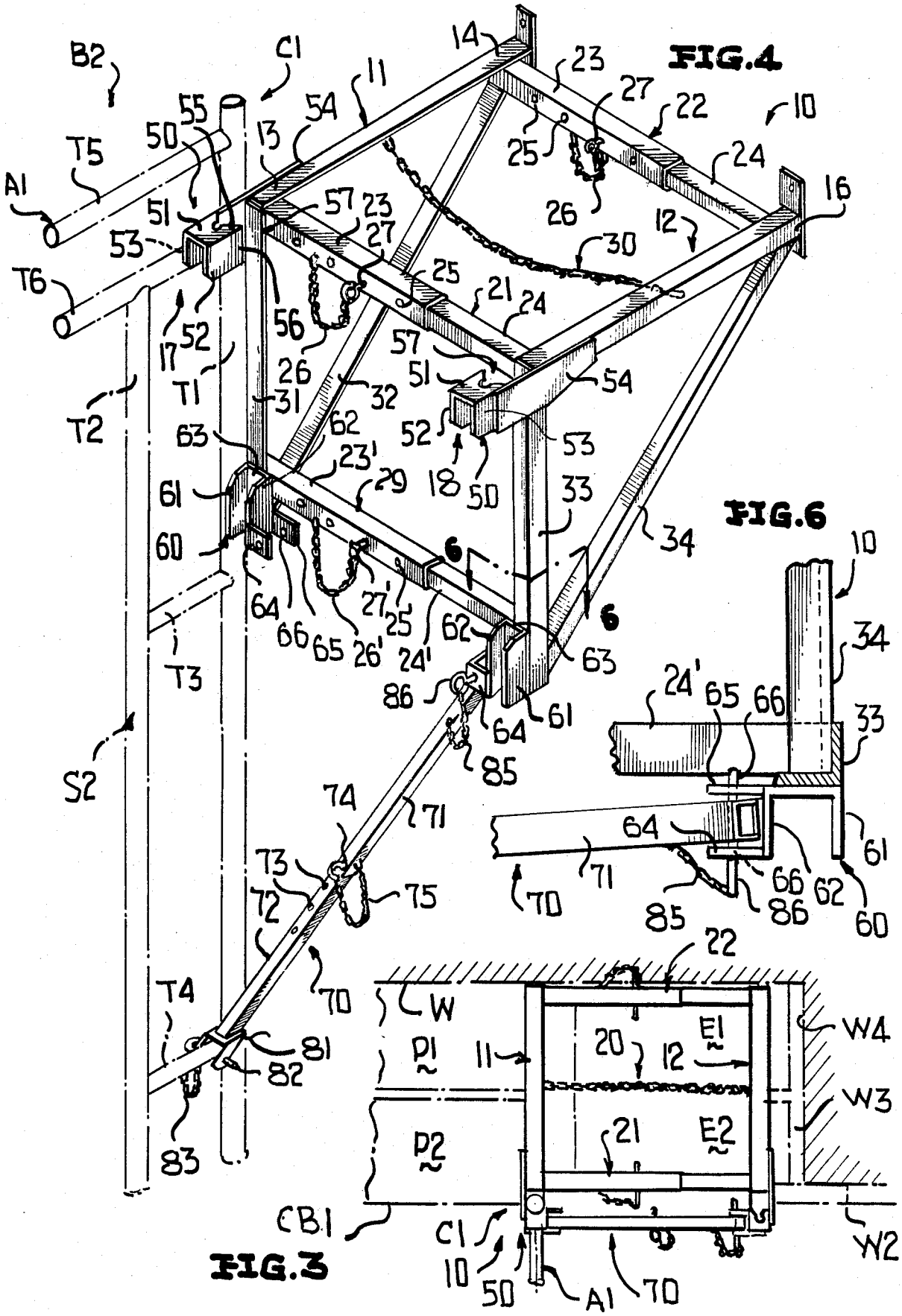
FIG. 3 is a top plan view of the outrigger, and illustrates the manner in which end portions of planks supported thereby can be positioned immediately adjacent the work area.
FIG. 4 is an enlarged perspective view of the outrigger of FIG. 1, and illustrates the outrigger projecting endwise from the associated scaffold buck in cantilevered relationship thereto.
FIG. 6 is an enlarged fragmentary sectional view taken generally along line 6—6 of FIG. 4, and illustrates a lower clamp of the outrigger and a pin connecting the cross brace thereto.

Scaffolding S of FIG. 1 is of a conventional construction and includes two separate scaffolds S1 and S2 The scaffolds S1, S2 are identical, and each include spaced scaffold bucks B1, B2 which are in generally parallel vertical planes. Cross-braces CB1, CB2 are centrally pivoted (unnumbered) to each other and are disposed in generally parallel vertical planes with opposite ends being connected to the bucks B1, B2 of the scaffolds S1, S2. The cross-braces CB1, CB2 are constructed from flat steel or angle-iron whereas the bucks B1, B2 are normally formed from tubes or tubing welded together.

The scaffold buck B2 of the scaffolding S2 will be described immediately hereinafter in detail, and the description and the components are equally applicable to the scaffolding buck or tubular staging B1 of the scaffolding S2 and the bucks B1, B2 of the scaffolding S1.

The scaffold buck B2 of the scaffolding S2 includes two vertical legs L1, L2 and a horizontal arm A1. The legs L1, L2 are formed by two generally parallel tubes T1, T2 welded to horizontal tubes T3, T4 with each tube T2 having a bent lower end portion (unnumbered) which is also welded to the associated tube T1. The upper end portions (unnumbered) of the tubes T1 are open and have a diameter such as to receive ties, plugs or reduced lower end portions (unnumbered) of the superimposed scaffolding, as is conventional and is depicted in FIG. 1 with the lower ends of the T1 of the bucks B1, B2 being shown in internal telescopic relationship to the upper ends of the tubes T1 of the bucks B1, B2 of the lower scaffolding S1. Generally parallel tubes T5, T6 define the arm A1 of the buck B2 of the scaffolding S2, and these tubes T5, T6 are welded to the tubes T1 of the legs L1, L2. The tube T6 is also welded to the tubes T2 of each of the legs L1.

For purposes of description and ease of understanding, the bucks B1, B2 define "ends" of the respective scaffolds S1, S2 whereas the cross-braces CB1, CB2 define "sides" of the scaffolding S1, S2. In this context a conventional brace BC projects sideways from the buck B1 of the scaffolding S2 toward a wall W of a house H or like building under construction or repair. Planks or planking P1, P2 are positioned in a horizontal plane and are underlyingly supported in spanning relationship by the conventional bracket BC and a novel scaffold extension unit or outrigger 10 of this invention which will be described more fully hereinafter. Furthermore, for ease of understanding, the outrigger is illustrated in FIG. 1 secured to a corner C1 of the upper scaffolding S2 defined by the buck B2 and the cross-brace CB1 secured thereto. The scaffolding S2 has, of course, three other corners C2, C3 and C4. The corner C2 is defined by the cross-brace CB1 and the buck B1 of the scaffolding S2. The corner C3 is defined by cross-brace CB2 and the buck B1 of the scaffolding S2. The corner C4 is defined by the cross-brace CB2 and the buck B2 of the scaffolding S2.

As the wall W of the house H is being bricked from ground level GL upwardly, the workmen, carpenters, bricklayers, masons, etc. similarly begin work at ground level GL. However, as the work elevates so too must the workmen, thereby requiring the use of the scaffold S1. A bricklayer might, for example, begin laying courses of brick upwardly from ground level GL along the wall W and an adjacent wall W1 with which another wall W2 in part defines a chimney C which further might include the usual rake or rake wall W3 and an uppermost offset wall W4 normally closely surrounding the fireplace flue (not shown). While at ground level GL, the bricklayer can readily lay bricks upwardly along the walls W and W1. As the walls W, W1 increase in height, the scaffold S1 can be positioned as shown with the buck B2 of the scaffold S1 closely adjacent and in a plane generally parallel to the wall W1 (FIG. 2). At this juncture the planks P1, P2 might span only the arms A1 of the bucks B2 of the lower scaffolding S1. However, normally a conventional bracket, such as the bracket BC would be connected to the bucks B1, B2 of the lower scaffold S1 projecting sidewise therefrom toward the wall W with the planks P1, P2 positioned thereupon. Thus, the worker could then stand upon the planks P2 and continue laying brick upwardly along the walls W, W1. However, upon reaching the area at which the rake or rake wall W3 is to be constructed, eventually the bricklayer must start laying bricks endwise beyond the buck B2 of the scaffold S2. The longer the rake W3, the further the bricklayer must lean beyond the buck B2 of the scaffolding S2 or any jerry-rigged projection of the planks P1, P2, such as that heretofore noted. The latter efforts are dangerous and subject the workman to injury, but in accordance with the present invention the outrigger or scaffold extension unit 10 can be secured at the corner C1 of any or all scaffolds S1, S2 to support the planks P1, P2 endwise beyond the buck B2 in cantilevered fashion at any time to lay bricks along the rake W3 or further upwardly along the wall W4. In this manner, ends E1, E2 of the planks P1, P2, respectively, are underlyingly supported immediately adjacent the wall W4 (FIG. 2), for example, to assure that as these ends E1, E2 are stepped upon by a workman's feet F (FIG. 2), the planks P1, P2 will not tip, cant or pivot, and the workman is safely supported as he performs whatever might be his task.

Reference is particularly made to FIG. 4 of the drawings which illustrates the novel outrigger or scaffold extension unit of this invention which includes first and second generally parallel horizontal arms 11, 12 formed of angle iron and each having respective ends 13, 14 and 15, 16. The arms 11, 12 each carry respective identical means 17, 18 for removably connecting the arms 11 and/or 12 selectively to any of the legs L1, L2 of the bucks B1, B2 depending, of course, upon the particular task at hand. The outrigger 10 is shown in FIGS. 1 and 4 supported by the connecting means 17 of the arm 11 to the arm A1 and the leg L1 of the buck B2 of the scaffold S2.

The arm 12 is also supported in cantilevered fashion by the arm 11 by two extensible cantilever arm means or cantilever arms 21, 22. Cantilever arms 21, 22 are disposed in generally parallel relationship to each other, and each includes an outer tube 23 slidable telescopically receiving therein an inner tube 24 with each of the tubes 23, 24 being generally of a rectangular transverse cross-section. The tubes 23 of the cantilever arms 21 22 are welded to the arm 11 while the tubes 24 are welded to the arm 12. Each tube 23 also has a series of holes 25 while each of the tubes 24 has at least one hole (not shown). A chain 26 is fixed to each of the tubes 23 and carries a pin 27 which can be selectively inserted through any of the holes 25 of the tubes 23 and the selected hole (not shown) of the tube 24 to lock the tubes 23, 24 in one of several different positions of relative telescopic adjustment at which the arm 12 can be selectively closer to or more remote from the arm 11 depending, of course, upon the distance of the wall W4, for example, from the plane of the buck B2 of the scaffold S2 (FIG. 1). The pins 27 function as means for preventing the tubes or arms 23, 24 from inadvertent slidable disassembly, and to further assure that the latter will not occur, the ends (not shown) of the pins 27 are preferably freely pivoted in a conventional manner. In this manner the pivoted ends must be aligned with the remainder of the pins 27 before the pins 27 can be withdrawn from the aligned holes of the tubes or arms 23, 24. Furthermore, means in the form of a flexible element or chain 30 is provided for preventing the arms 11, 12 from disassembling, even should the pins 27 not be in any of the holes 25 or the unillustrated holes associated with the tube 24. The chain 30 is welded to the arms 11, 12 only after the tubes 24 have been inserted in the tubes 23 of the cantilever arms 21, 22. Furthermore, the length of the chain 30 is appreciably less than twice the total length of the arms 23, 24. Thus, when the arms 23, 24 are in telescopic relationship and the pins are removed from the holes thereof, the arm 12 can be pulled to the right in FIG. 4, but the chain 30 will become taut and prevent the arms 24 from being withdrawn from the arms 23 of the cantilever arms 21, 24. This safeguard prevents accidental disassembly of the outrigger 10 and attendant damage/injury to a person standing upon the planks P1, P2 supported thereby.

A vertical arm 31 and an oblique arm 32 are welded to each other and to the horizontal arm 11. A similar vertical arm and an oblique arm 34 are also welded to each other and to the arm 12. The arms 11, 31, 32 and the arms 12, 33, 34 thereby collectively define a generally triangular frame which is quite rigid, and this rigidity is enhanced by still another cantilever arm 29 identical in structure to the cantilever arms 21, 22 and bearing identical though primed reference numerals for identical structure.

The connecting or clamping means 17, 18 each include a generally inverted U-shaped saddle member or bracket 50 defined by a top wall 5*i* and depending side walls 52, 53 with each all 53 being welded to a plate 54 which is in turn welded to the ends 13, 15 of the respective horizontal arms 11, 12. Each top wall 51 has a generally V-shaped notch or edge 55 (FIG. 5) which diverges toward the ends 13, 15 of the respective arms 12. Each wall 52 also has a vertical edge 56 (FIGS. 4 and 5) spaced from the respective vertical arm 31, 33 and defining therewith a vertical slot 57 substantially greater in distance than the diameter of the tube T1.

In order to suspend the outrigger 10 from the buck B2 of the scaffold S1, the portion of the tube T1 (FIG. 4) between the tubes T6 is introduced into the slot 57 when the wall 51 of the connecting means 17 is immediately adjacent but slightly below the tube T5 The entire outrigger 10 is then dropped vertically downwardly bringing the saddle or bracket 50 into embracing relationship to the tube T6. In this position (FIG. 4) the walls 52, 53 of the saddle 50 intimately embrace the tube T6 and function to prevent rotation of the entire outrigger 10 about the axis of the tube T1. The V-shaped edge 55 also bears against the tube T1 (FIG. 5) and this prevents sideways outward movement (to the right in FIG. 4) of the outrigger 10. The outrigger 10 is also prevented from canting or tipping downwardly by a pair of identical saddles or brackets 60 each defined by a pair of walls 61, 62 in generally spaced parallel relationship to each other and a bight wall 63 therebetween which is welded to the respective vertical arms 31, 33. The walls 61, 62 are spaced from each other a distance slightly greater than the tube T1 to slidingly embrace the same. Thus, when the outrigger 10 is assembled as shown in FIG. 4 with the saddle bracket 60 adjacent the arm 31 embracing the tube T1, any loading sidewise (or endwise) upon the outrigger 10 is effectively resisted and the outrigger is maintained in a highly stabilized condition upon the buck B2 of the scaffold S1 (FIG. 4).

An auxiliary reinforcing support mechanism or support 70 is also provided in conjunction with a pair of spaced flanges 64, 65 having openings 66 therein carried by the wall 62 of each of the brackets 60. The auxiliary support 70 includes a pair of relatively telescopic arms or tubes, the outer tube being designated by the reference numeral 71 and the inner telescopic tube by the reference numeral 72. The arm 72 has a plurality of holes 73 for receiving a pin 74 carried by chains 75 fixed to the tube 71. The pin passes through a hole (unnumbered) of the tube 71 and mates with any of the holes 73 of the tube 74 to maintain a predetermined length of the telescopic auxiliary support 70.

The tube 71 also carries another chain 85 and a pin 86 which passes through the openings 66 (FIG. 6) and an opening 87 of the arm 71

The arm 72 carries a U-shaped bracket 8I whose legs (unnumbered) have apertures (also unnumbered) for receiving a pin 82 carried by a chain 83 to thereby retain the bracket 81 connected to the tube T4. The auxiliary support 70 is just that, namely, a support which need not necessarily be used since the outrigger 10 is sufficient to support virtually any load reasonly applied upon the ends or end portions El, E2 of the planks PI. P2 (FIG. 1). However, should for some reason inordinate loading develop during construction, the auxiliary support 70 can be positioned as shown best in FIG. 4 and most any normal or expectant load can be readily supported by the outrigger 10.

By referring to FIG. 1, it should be noted that the outrigger can be as well coupled to the corner C1 to project endwise (to the left) of the buck B1 of the scaffold S2 by simply connecting the connecting means 18 to the corner C2. In this case the arm 12 would project toward the wall W and lie generally in the plane of the buck B1 while, of course, the arm 11 would be to the left thereof. Obviously, the outrigger 10 can as well project endwise from the scaffolding S2 at the corners C3 and C4 in an obvious manner.

Although a preferred embodiment of the invention has been specifically illustrated and described herein, it is to be understood that minor variations may be made in the apparatus without departing from the spirit and scope of the invention, as defined in the appended claims.

I claim:

1. In combination with a scaffold which includes at least four generally vertical members each establishing a respective corner of said scaffold, first and second generally parallel horizontal members, said first generally horizontal member spanning and being connected to first and second of said generally vertical members, said second generally horizontal member spanning and being connected to third and fourth of said generally vertical members, said scaffold being of a generally polygonal configuration as viewed in plan with said polygonal configuration being defined by four vertical planes spanning said first and second corners, said second and fourth corners, said third and fourth corners and said first and third corners, and at least one generally horizontal plank spanning and supported by said generally horizontal members, the improvement comprising means for supporting a second generally horizontal plank positioned in generally side-by-side relationship to said one plank at an end portion of said second generally horizontal plank appreciably outboard of said polygonal configuration in the direction of the length of said second horizontal plank, said second plank supporting means including first and second generally parallel horizontal arms, a first of said arms having means at one end thereof for removably connecting said first arm to one of said vertical members and underlyingly supporting said second horizontal plank, said first arm lying generally parallel to the most adjacent of said four planes which is normal to the direction of the length of said second plank, said second arm being appreciably spaced from said first arm and in underlying supporting relationship to said second plank at a point most adjacent a free edge of said second plank, and cantilever arm means for cantilever-supporting said second arm from said first arm appreciably outboard of said most adjacent plane in a direction normal thereto.

2. The scaffold combination as defined in claim 1 including means for varying the distances between said first and second arms.

3. The scaffold combination as defined in claim 1 including means for varying the length of said cantilever arm means thereby varying the distances between said first and second arms.

4. The scaffold combination as defined in claim 1 including means for selectively adjusting the length of said cantilever arm means thereby varying the distances between said first and second arms.

5. The scaffold combination as defined in claim 1 wherein said cantilever arm means are a pair of relatively slidably connected arms and means for preventing said pair of slidably connected arms from slidably disconnecting.

6. The scaffold combination as defined in claim 1 including means for selectively adjusting the length of said cantilever arm means thereby varying the distances between said first and second arms, and said length adjusting means include selectively aligned openings and a pin receivable therein.

7. The scaffold combination as defined in claim 1 wherein said cantilever arm means are a pair of relatively slidably connected arms and means for preventing said pair of slidably connected arms from slidably disconnecting and said preventing means include selectively aligned openings in said pair of slidable arms and a pin receivable therein.

8. The scaffold combination as defined in claim 1 wherein said cantilever arm means are a pair of relatively slidably connected arms, means for selectively adjusting the length of said pair of slidable arms to thereby vary the distance between said first and second arms, and said length adjusting means includes selectively aligned openings in said pair of slidable arms and a pin receivable therein.

9. The scaffold combination as defined in claim 1 wherein said cantilever arm means are a pair of relatively slidably connected arms and means for preventing said pair of slidably connected arms from slidably disconnecting, and said preventing means is a flexible element connected so as to limit maximum movement of said first and second arms away from each other at which said pair of arms remain in slidable connected relationship.

10. The scaffold connection as defined in claim 1 including means for preventing rotation of said second plank supporting means about a vertical axis of said one vertical member.

11. The scaffold connection as defined in claim 1 wherein said first and one vertical members are one and the same, and means adjacent said first arm one end for sandwiching said first horizontal member therebetween to prevent rotation of said second plank supporting means about a vertical axis of said one vertical member.

12. The scaffold connection as defined in claim 1 wherein said first and one vertical members are one and the same, means adjacent said first arm one end for sandwiching said first horizontal member therebetween to prevent rotation of said second plank supporting means about a vertical axis of said one vertical member, and said rotation preventing means are a pair of legs between which said first horizontal member is embraced.

13. The scaffold connection as defined in claim 1 wherein said first and one vertical members are one and the same, means adjacent said first arm one end for sandwiching said first horizontal member therebetween to prevent rotation of said second plank supporting means about a vertical axis of said one vertical member, and said rotation preventing means is a generally saddle-like member defined by a bight and a pair of legs between which said first horizontal member is embraced.

14. The scaffold connection as defined in claim 1 wherein said second horizontal arm has means at one end thereof for removably connecting said second arm to at least one other of said vertical members whereby said first arm can be cantilever-supported from said second arm through said cantilever arm means thereby adapting said second plank supporting means for operability at each of said four vertical members.

15. The scaffold combination as defined in claim 1 wherein said removable connecting means is a slot in said first arm one end opening in a direction toward said second arm.

16. The scaffold connection as defined in claim 1 wherein said second horizontal arm has means at one end thereof for removably connecting said second arm to at least one other of said vertical members whereby said first arm can be cantilever-supported from said second arm through said cantilever arm means thereby adapting said second plank supporting means for operability at each of said four vertical members, and said first and second arm removable connecting means are each a slot opening toward each other.

17. The scaffold combination as defined in claim 1 wherein said cantilever arm means are a pair of generally parallel horizontal third and fourth arms connected between said first and second horizontal arms.

18. The scaffold combination as defined in claim 1 wherein said cantilever arm means are a pair of generally parallel horizontal third and fourth arms connected between said first and second horizontal arms, first and second pairs of angularly oriented arms each defined by a generally vertical arm and an oblique arm interconnected to each other at an included acute angle corner, and ends of said vertical and oblique arms remote from the respective acute angle corners thereof being connected to a respective one of said first and second horizontal arms.

19. The scaffold combination as defined in claim 1 wherein said cantilever arm means are a pair of generally parallel horizontal third and fourth arms connected between said first and second horizontal arms, first and second pairs of angularly oriented arms each defined by a generally vertical arm and an oblique arm interconnected to each other at an included acute angle corner, ends of said vertical and oblique arms remote from the respective acute angle corners thereof being connected to a respective one of said first and second horizontal arms, and a third generally horizontal arm connected in spanning relationship to and between said acute angle corners and in generally parallel relationship to said first and second horizontal arms.

20. The scaffold connection as defined in claim 2 including means for preventing rotation of said second plank supporting means about a vertical axis of said one vertical member.

21. The scaffold connection as defined in claim 2 wherein said second horizontal arm has means at one end thereof for removably connecting said second arm to at least one other of said vertical members whereby said first arm can be cantilever-supported from said second arm through said cantilever arm means thereby adapting said second plank supporting means for operability at each of said four vertical members.

22. The scaffold combination as defined in claim 14 wherein said cantilever arm means are a pair of relatively slidably connected arms and means for preventing said pair of slidably connected arms from slidably disconnecting.

23. The scaffold combination as defined in claim 14 wherein said cantilever arm means are a pair of relatively slidably connected arms, means for selectively adjusting the length of said pair of slidable arms to thereby vary the distance between said first and second arms, and said length adjusting means includes selectively aligned openings in said pair of slidable arms and a pin receivable therein.

24. The scaffold combination as defined in claim 16 wherein said cantilever arm means are a pair of relatively slidably connected arms and means for preventing said pair of slidably connected arms from slidably disconnecting.

25. The scaffold combination as defined in claim 16 wherein said cantilever arm means are a pair of relatively slidably connected arms, means for selectively adjusting the length of said pair of slidable arms to thereby vary the distance between said first and second arms, and said length adjusting means includes selectively aligned openings in said pair of slidable arms and a pin receivable therein.

26. The scaffold combination as defined in claim 23 wherein said cantilever arm means are a pair of generally parallel horizontal third and fourth arms connected between said first and second horizontal arms, first and second pairs of angularly oriented arms each defined by a generally vertical arm and an oblique arm interconnected to each other at an included acute angle corner, and ends of said vertical and oblique arms remote from the respective acute angle corners thereof being connected to a respective one of said first and second horizontal arms.

27. The scaffold combination as defined in claim 25 wherein said cantilever arm means are a pair of generally parallel horizontal third and fourth arms connected between said first and second horizontal arms, first and second pairs of angularly oriented arms each defined by a generally vertical arm and an oblique arm interconnected to each other at an included acute angle corner, and ends of said vertical and oblique arms remote from the respective acute angle corners thereof being connected to a respective one of said first and second horizontal arms.

28. A scaffold extension unit adapted to be utilized at the corner of a scaffold in generally cantilever-like fashion to underlyingly support the free end portion of a horizontal plank outboard of an associated scaffold comprising a pair of generally spaced parallel first and second arms adapted to be positioned in a horizontal plane relative to an associated scaffold, each of said first and second arms having respective inboard first and outboard second ends, said first and second arms first inboard ends each having means for removably connecting said arms selectively to any one of a plurality of vertical members of an associated scaffold, each of said removable connecting means including a hook-like element having a lateral opening for sidewise connection to a vertical scaffold member with said hook-like element in embracing relationship thereto, said first and second arm first inboard ends each having means for preventing rotation of said unit about a vertical axis of an associated vertical scaffold member, and cantilever arm means for cantilever-supporting said first and second arms from each other dependent upon which is connected by its removable connecting means to an associated scaffold vertical member.

29. The scaffold extension unit as defined in claim 28 including means for varying the distance between said first and second arms.

30. The scaffold extension unit as defined in claim 28 including means for varying the length of said cantilever arm means thereby varying the distance between said first and second arms.

31. The scaffold extension unit as defined in claim 28 including means for selectively adjusting the length of said cantilever arm means thereby varying the distance between said first and second arms.

32. The scaffold extension unit as defined in claim 28 including means for selectively adjusting the length of said cantilever arm means thereby varying the distance between said first and second arms, said cantilever arm means are a pair of relatively slidably connected arms, and said length adjusting means include selectively aligned openings in said pair of slidable arms and a pin receivable therein.

33. The scaffold extension unit as defined in claim 28 including means for selectively adjusting the length of said cantilever arm means thereby varying the distance between said first and second arms, said cantilever arm means are a pair of relatively slidably connected tubular arms, and said length adjusting means include selectively aligned openings in said pair of slidable tubular arms and a pin receivable therein.

34. The scaffold extension unit as defined in claim 28 wherein said rotation preventing means are a pair of legs between which a horizontal scaffold member is adapted to be embraced.

35. The scaffold extension unit as defined in claim 28 wherein said lateral openings of said hook-like elements open laterally toward each other.

36. The scaffold extension unit as defined in claim 28 wherein said cantilever arm means are a pair of generally parallel horizontal third and fourth arms connected between said first and second horizontal arms, first and second pairs of angularly oriented arms each defined by a generally vertical arm and an oblique arm interconnected to each other at an included angle corner, ends of said vertical and oblique arms remote from the respective acute angle corners thereof being connected to a respective one of said first and second horizontal arms, and a generally vertically disposed saddle-like member at each acute angle corner for embracing an associated scaffold vertical member.

37. The scaffold extension unit as defined in claim 28 wherein said cantilever arm means are a pair of generally parallel horizontal third and fourth arms connected between said first and second horizontal arms, first and second pairs of angularly oriented arms each defined by a generally vertical arm and an oblique arm interconnected to each other at an included angle corner, ends of said vertical and oblique arms remote from the respective acute angle corners thereof being connected to a respective one of said first and second horizontal arms, a fifth generally horizontal arm connected in spanning relationship to and between said acute angle corners and in generally parallel relationship to said third and fourth horizontal arms, and a generally vertically disposed saddle-like member at each acute angle corner for embracing an associated scaffold vertical member.

38. The scaffold extension unit as defined in claim 28 wherein said cantilever arm means are a pair of generally parallel horizontal third and fourth arms connected between said first and second horizontal arms, first and second pairs of angularly oriented arms each defined by a generally vertical arm and an oblique arm interconnected to each other at an included angle corner, ends of said vertical and oblique arms remote from the respective acute angle corners thereof being connected to a respective one of said first and second horizontal arms, a fifth generally horizontal arm connected in spanning relationship to an between said acute angle corners and in generally parallel/relationship to said third and fourth horizontal arms, means for selectively adjusting the length of said third, fourth and fifth arms thereby varying the distance between said first and second arms, and a generally vertically disposed saddle-like member at each acute angle corner for embracing an associated scaffold vertical member.

39. The scaffold extension unit as defined in claim 36 wherein said rotation preventing means are a pair of legs between which a horizontal scaffold member is adapted to be embraced.

40. The scaffold extension unit as defined in claim 36 wherein said lateral openings of said hook-like elements open laterally toward each other.

41. The scaffold extension unit as defined in claim 37 wherein said rotation preventing means are a pair of legs between which a horizontal scaffold member is adapted to be embraced.

42. The scaffold extension unit as defined in claim 37 wherein said lateral openings of said hook-like elements open laterally toward each other.

43. The scaffold extension unit as defined in claim 38 wherein said rotation preventing means are a pair of legs between which a horizontal scaffold member is adapted to be embraced.

44. The scaffold extension unit as defined in claim 38 wherein said lateral openings of said hook-like elements open laterally toward each other.

* * * * *